US008365712B2

(12) United States Patent
Jolley et al.

(10) Patent No.: US 8,365,712 B2
(45) Date of Patent: Feb. 5, 2013

(54) LIMB CONNECTION APPARATUS FOR ARCHERY BOWS

(75) Inventors: Gideon S. Jolley, Syracuse, UT (US); Douglas E. Denton, Stansbury Park, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 334 days.

(21) Appl. No.: 12/815,337

(22) Filed: Jun. 14, 2010

(65) Prior Publication Data

US 2011/0303203 A1 Dec. 15, 2011

(51) Int. Cl.
*F41B 5/20* (2006.01)

(52) U.S. Cl. ..... 124/89; 124/23.1; 124/86

(58) Field of Classification Search ..... 124/23.1, 124/25.6, 89, 86, 88
See application file for complete search history.

(56) References Cited

U.S. PATENT DOCUMENTS

| | | | | |
|---|---|---|---|---|
| 3,525,322 | A * | 8/1970 | Lee | 124/89 |
| 4,135,486 | A * | 1/1979 | Enomoto | 124/89 |
| 5,388,563 | A * | 2/1995 | Hsu | 124/23.1 |
| 6,298,842 | B1 * | 10/2001 | Sims | 124/89 |
| 6,526,957 | B1 * | 3/2003 | Leven | 124/89 |

* cited by examiner

*Primary Examiner* — John Ricci
(74) *Attorney, Agent, or Firm* — Holland & Hart

(57) ABSTRACT

A traditional archery bow includes a handle assembly, a bowstring, and at least one connection apparatus. The handle assembly includes a riser, an upper limb, and a lower limb. The upper and lower limbs each include a proximal end connected to the riser and a distal end. The bowstring extends between the distal ends of the upper and lower limbs. The at least one connection apparatus is mounted to at least one of the upper or lower limbs. An accessory such as a bushing or stabilizer may be mounted to one of the limbs with the connection apparatus.

32 Claims, 10 Drawing Sheets

LIMB CONNECTION APPARATUS FOR ARCHERY BOWS

TECHNICAL FIELD

The present disclosure is directed to archery bows and accessories for archery bows, and more particularly to features of an archery bow used to connect devices or accessories to the archery bow.

BACKGROUND

Traditional archery bows (e.g., longbows and recurve bows) typically include a pair of oppositely extending limbs connected to a handle or riser. The handle riser may be integral with the limbs or a separate, disconnectable structure. The bowstring is attached directly to distal ends of the limbs. When the archer draws the bowstring, the limbs store energy to propel an arrow upon release of the bowstring. The greater portion of the stored energy goes into the launching of the arrow and most of the remainder finds its way back into the bow with the excess resulting in noise or is simply lost in the transfer process. Some of the energy that goes back into the bow returns the bow to its original undrawn state, but much of the energy goes into excessive movement of various bow components resulting in bow hand shock and system vibrations.

A number of devices and accessories have been developed that assist in dissipating shock and vibration in traditional archery bows, thereby eliminating some of the adverse consequences of such shock and vibration. Such devices and accessories are typically mounted directly to the riser portion of the bow.

SUMMARY

One aspect of the present disclosure relates to a traditional archery bow that includes a handle assembly, a bowstring, and at least one connection apparatus. The handle assembly includes a riser, to which is coupled an upper limb and a lower limb. The upper and lower limbs each include a proximal end connected to the riser and a distal end. The bowstring extends between the distal ends of the upper and lower limbs. The at least one connection apparatus is mounted to at least one of the upper or lower limbs.

The connection apparatus may provide an access direction facing away from the bowstring. The connection apparatus may include a threaded portion. The connection apparatus may be positioned distal of the riser. The connection apparatus may be positioned lateral of a portion of the riser. The connection apparatus may be accessible from one side of the upper limb or the lower limb. The connection apparatus may have a generally circular cross-sectional shape and may define a generally circular shaped aperture. The connection apparatus may be positioned on a proximal end of the upper limb or the lower limb. The archery bow may further include a dampening member mounted to the connection apparatus. The archery bow may further include a stabilizer mounted to the connection apparatus. The upper and lower limbs may each be connected to the riser at one or more attachment points spaced apart relative to each other. The connection apparatus may be positioned between the attachment points on a particular limb.

Another aspect of the present disclosure relates to a recurve archery bow handle assembly that includes a riser, upper and lower limbs, and a connection apparatus. The upper and lower limbs extend from opposite ends of the riser. Each limb has a proximal end and a distal end. The connection apparatus is provided on one of the limbs at a location proximal of the proximal end of that limb.

The connection apparatus may be provided on a portion of the limb that overlaps a portion of the riser. The connection apparatus may be spaced from the riser either laterally or longitudinally along a length of the limb. The connection apparatus may include a bushing, wherein the bushing defining a threaded bore.

A further aspect of the present disclosure relates to a method of assembling a traditional archery bow. The method includes providing a riser, a pair of limbs, a bowstring, and an accessory, wherein at least one of the limbs comprises a connection apparatus. The method may also include connecting the limbs to opposite ends of the riser, extending the bowstring from one limb to the other limb, and mounting the accessory to the connection apparatus.

Mounting the accessory to the connection apparatus may include threadably engaging a threaded shaft of the accessory with a threaded bore of the connection apparatus. Providing the at least one connection apparatus may alternatively include providing a threaded connection between the connection apparatus and the limb. Connecting the limbs to opposite ends of the riser may include positioning the connection apparatus laterally from the riser. Connecting the limbs to opposite ends of the riser may include providing the connection apparatus spaced apart from the riser.

The foregoing and other features, utilities, and advantages of the subject matter described herein will be apparent from the following more particular description of certain embodiments as illustrated in the accompanying drawings.

DETAILED DESCRIPTION

Figure 1:
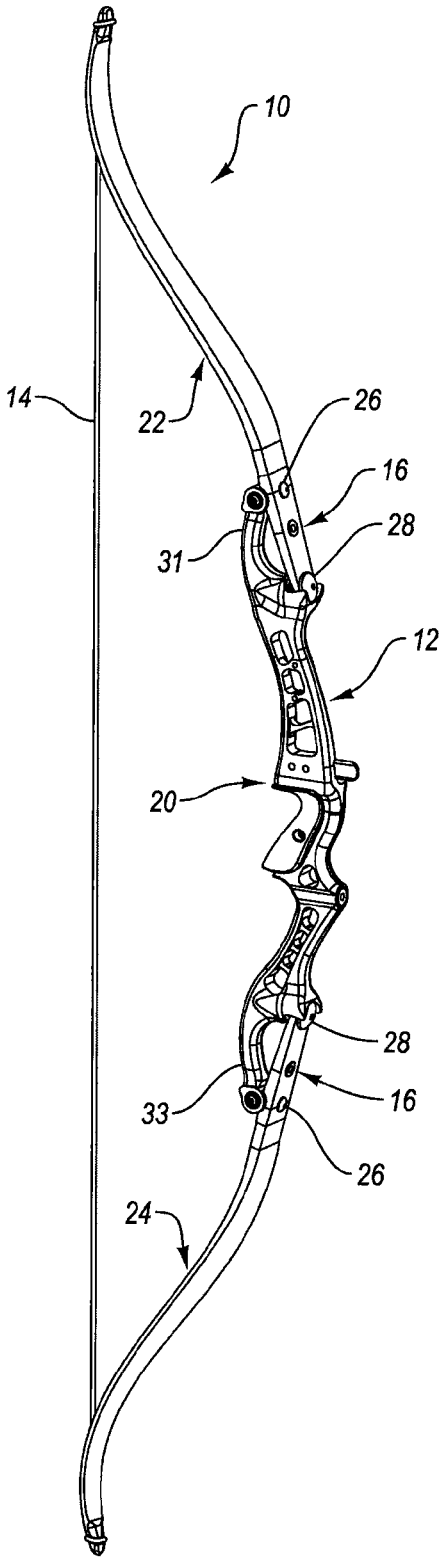
FIG. 1 is a perspective view of an example archery bow in accordance with the present disclosure.
Figure 2:
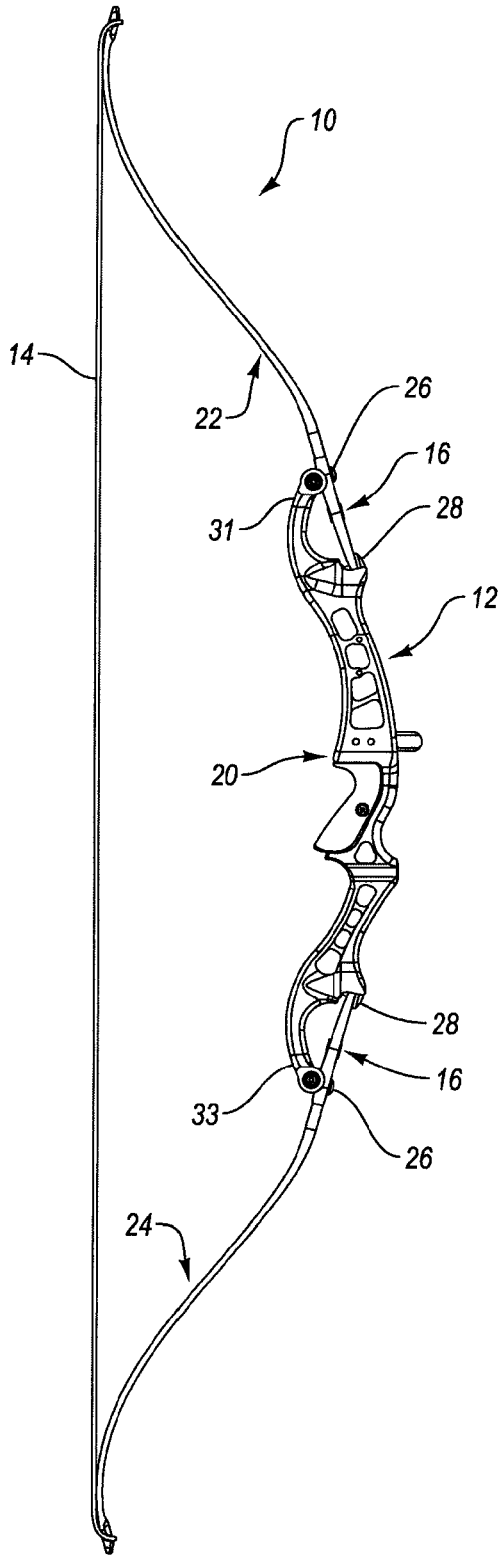
FIG. 2 is a side view of the archery bow shown in FIG. 1.
Figure 3:
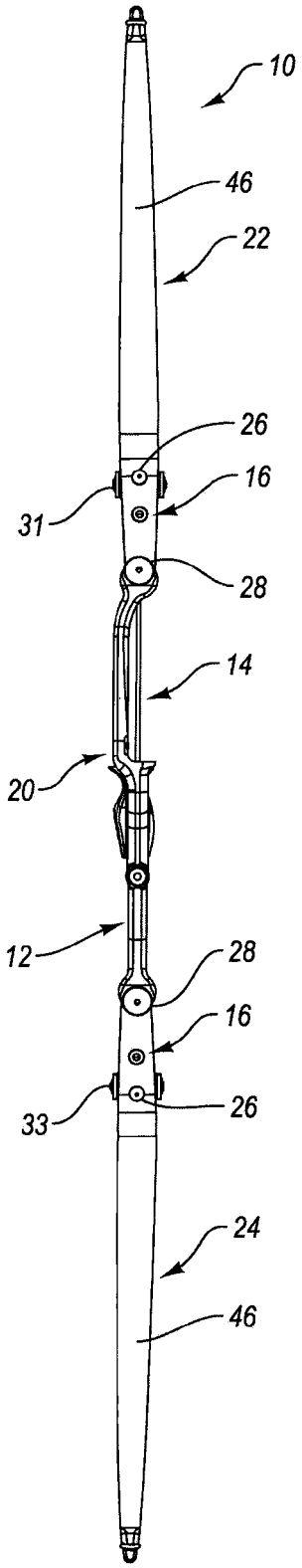
FIG. 3 is a front view of the archery bow shown in FIG. 1.
Figure 4:
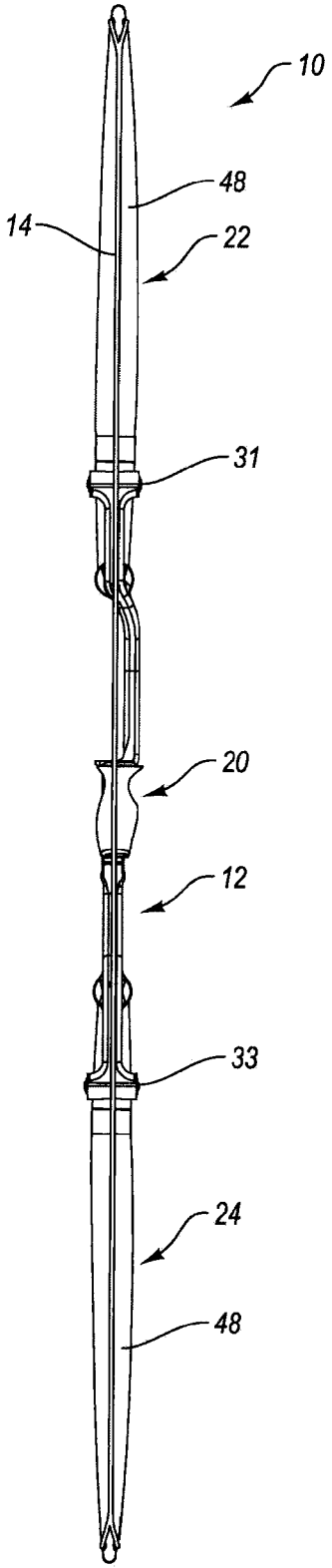
FIG. 4 is a rear view of the archery bow shown in FIG. 1.

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

The present disclosure is directed to an apparatus used for connecting components and/or accessories to a limb portion of an archery bow. Some aspects of the present disclosure may be directed specifically to a recurve bow, which is one type of traditional archery bow.

Various archery bow components and accessories may be mounted directly to the riser of the archery bow. Some example archery components and accessories include dampeners or shock absorbing devices, stabilizers, arrow rests, sights, quivers, and other apparatuses that perform a variety of functions. These components and accessories are typically mounted to the riser of the archery bow. The riser provides a rigid structure to which the component or accessory may be mounted. The riser provides a handle for the user to grasp when shooting the bow. This makes the riser a primary bow component through which shock and vibrations are transferred to the user. Further, risers often include a plurality of mounting surfaces along forward and rear facing sides of the archery bow as well as along lateral facing sides.

Traditional archery bows, such as recurve bows, may provide unique challenges related to mounting of archery components and accessories. The upper and lower limbs of a recurve bow typically have some curvature, particularly when a bowstring is secured to the distal ends of the limbs. The limbs further bend r flex when the bowstring is drawn, which makes the limbs traditionally undesirable for mounting components or other accessories.

One aspect of the present disclosure relates to positioning of a connection or mounting apparatus used for connecting an archery component or accessory to a recurve bow on at least one of the limbs rather than the riser portion of the bow. In one example, the connection apparatus includes a threaded bore sized and configured to receive a threaded shaft of the archery component or accessory (e.g., a stabilizer or dampening member). The connection apparatus may be positioned on the limb at a location that is spaced either forward, rearward, or lateral relative to the side of a portion of the riser. In other arrangements, the connection apparatus may be positioned at a location along the length of the limb that is spaced axially or longitudinally away from the riser.

An example connection apparatus for mounting archery components and accessories is arranged for mounting an archery component or accessory along the front facing or rear facing surface of the limb. In some arrangements, a connection apparatus is positioned along each of the upper and lower limbs. In still further arrangements, each limb is connected to the riser at two connection points and the connection apparatus is positioned at a location spaced between the connection points on a given limb.

Positioning the connection apparatus for mounting an archery component or accessory to the archery bow along at least one of the limbs of the bow may provide certain advantages. For example, when a dampening component is mounted to the archery bow via the connection apparatus provided on one of the limbs, the dampener may more effectively dampen vibrations in the archery bow when launching an arrow from the bow. Improved dampening may lead to improved shooting performance, reduced noise, and enhanced comfort for the user. In another example, positioning a connection apparatus along the limb portion of the archery bow provides added flexibility as to where the user positions an archery component or accessory to meet a number of preferences or objectives for the user.

The example connection apparatuses mounted on the limb portion of the archery bow as disclosed herein may be used in combination with other connection apparatuses that are mounted to a riser portion of an archery bow. Many combinations of connection apparatuses may be used for a given archery bow for mounting various archery components and accessories at any desired location along the riser and upper and lower limbs of the archery bow.

Referring now to FIGS. 1-9, an example archery bow 10 is shown and described. The archery bow 10 includes a riser assembly 12, a bow string 14, and at least one connection apparatus 16. The archery bow 10 may comprise an archery bow assembly, such as without limitation a recurve bow. Those skilled in the art will understand that the various aspects of the present disclosure may be used with other types of archery bows including other traditional bows and compound bows.

The riser 12 includes a handle 20, an upper limb 22, and a lower limb 24. Each of the limbs 22, 24 include curves in two different directions, thus helping define the "recurve" characteristic of a traditional recurve bow.

Figure 5:
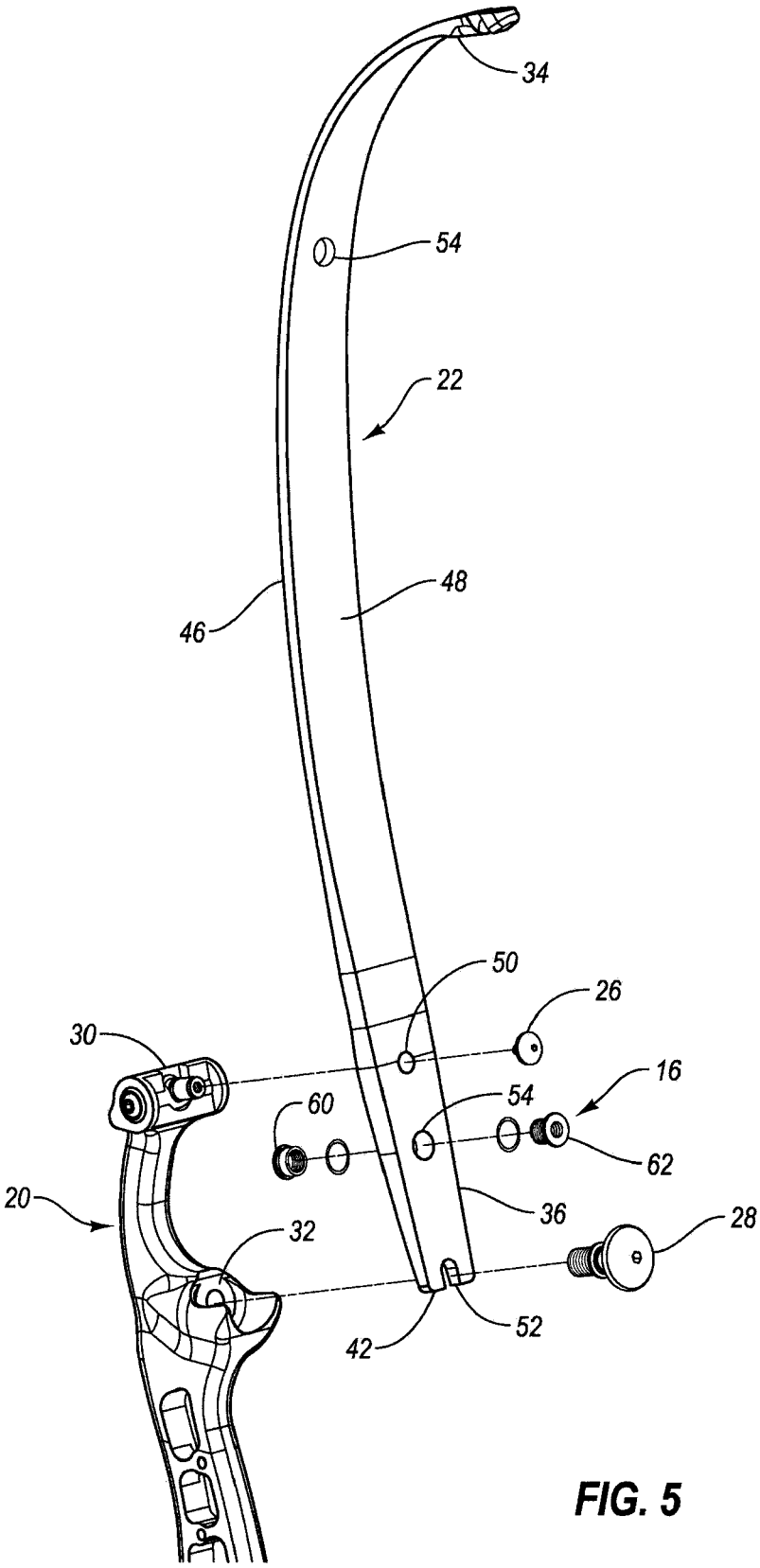
FIG. 5 is an exploded view of a portion of a handle assembly of the archery bow shown in FIG. 1.
Figure 6A:
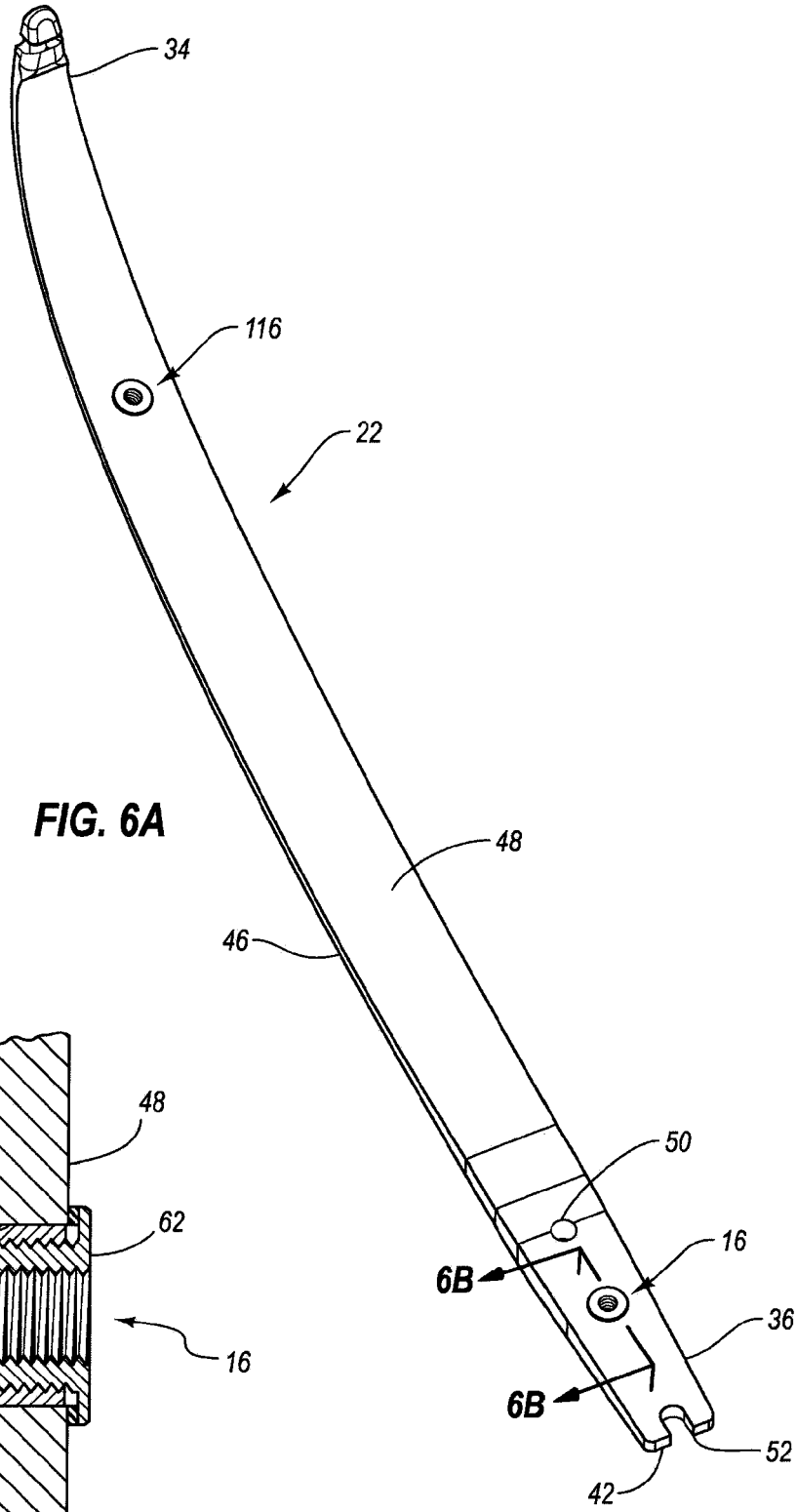
FIG. 6A is a perspective view of an upper limb of the archery bow shown in FIG. 1.
Figure 6B:
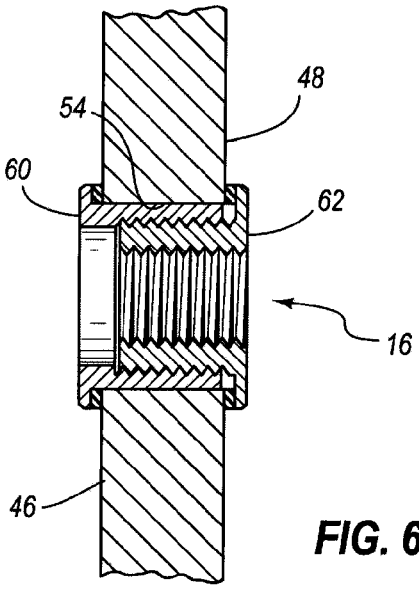
FIG. 6B is a cross-sectional view of the upper limb of FIG. 6A taken along cross-sectional indicators 6B-6B.
Figure 7:
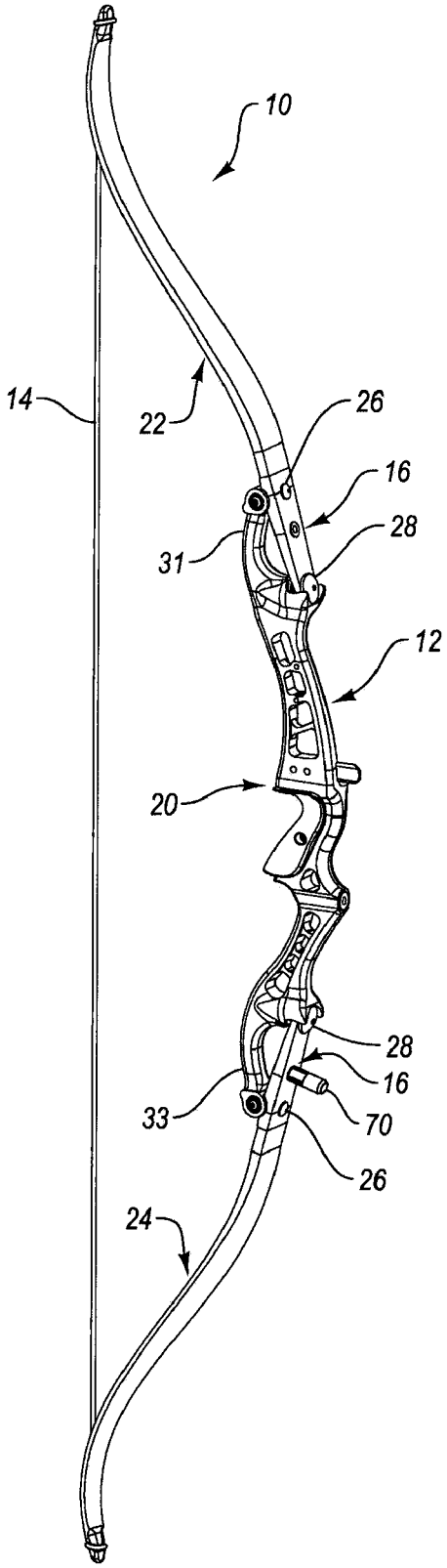
FIG. 7 is a perspective view of the archery bow shown in FIG. 1 with an archery component mounted to a connection apparatus along a lower limb of the archery bow.
Figure 8:
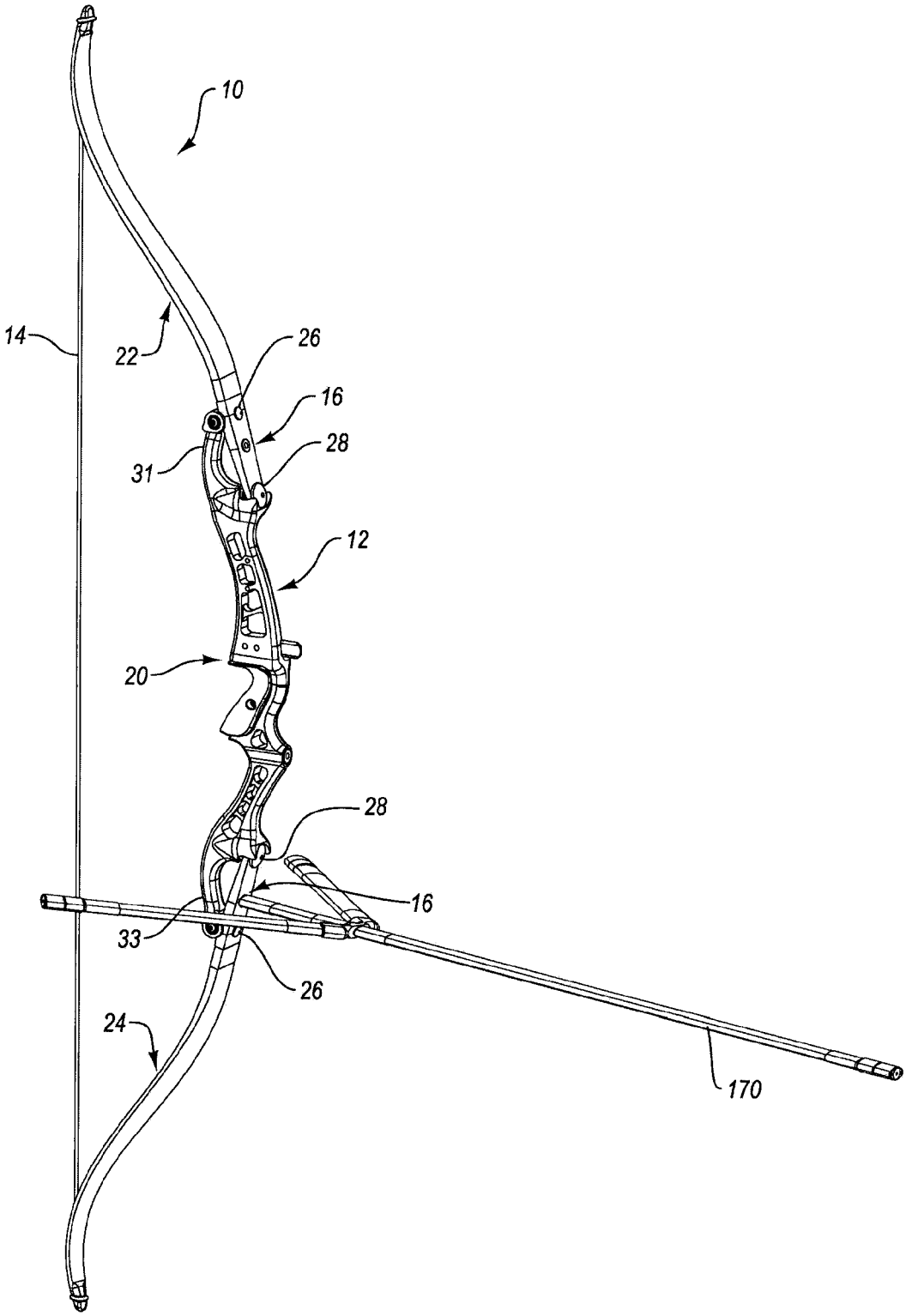
FIG. 8 is a perspective view of the archery bow shown in FIG. 1 with a bow stabilizer mounted to a connection apparatus along a lower limb of the archery bow.
Figure 9:
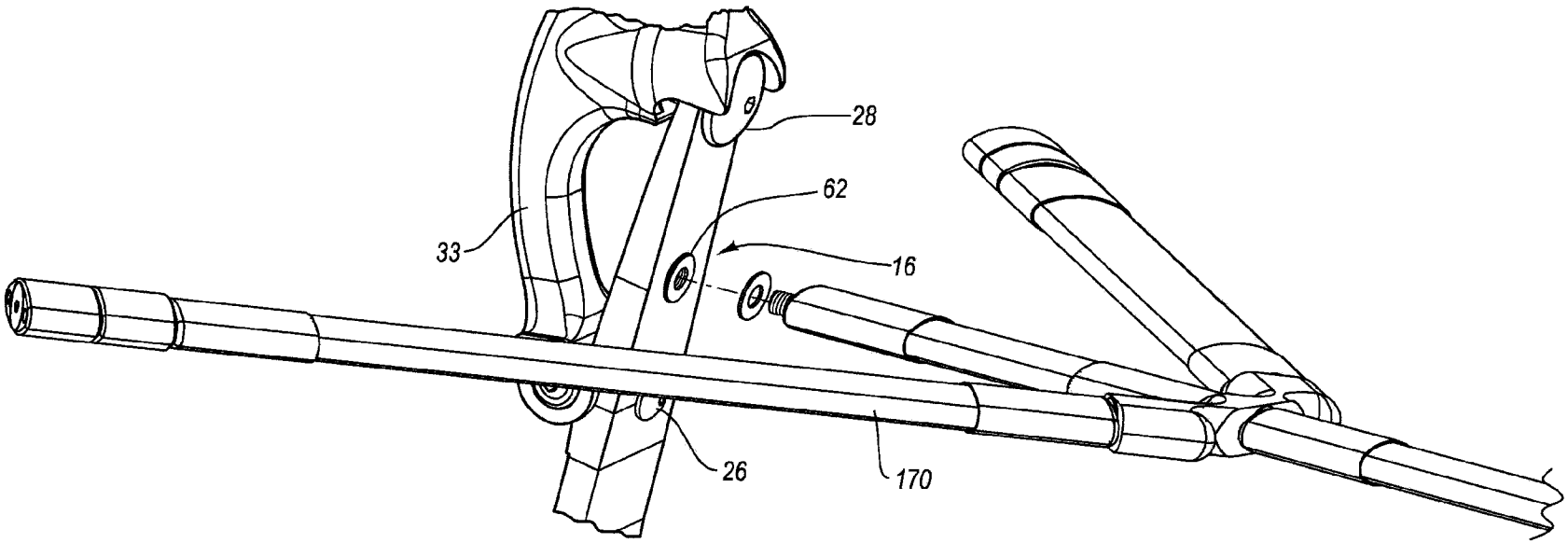
FIG. 9 is an exploded perspective view of the archery bow and stabilizer shown in FIG. 8.

Referring to FIG. 5, the riser 12 includes first and second limb mounting surfaces 30, 32 at opposing ends 31, 33 of the riser. Each of the limbs 22, 24 contact the riser assembly 12 at the mounting surfaces 30, 32. A pair of connection members 26, 28 is used to connect the limbs 22, 24 to the riser 20 at the mounting surfaces 30, 32.

The upper and lower limbs 22, 24 each include a distal end 34 and a proximal end 36 relative to the riser 12. The upper and lower limbs 22, 24 further include an end surface 42 at the proximal end 36 that may be positioned within limb mounting pocket 32. The upper and lower limbs 22, 24 include forward and rearward facing surfaces 46, 48, respectively. Typically, the forward surface 46 faces and contacts the first and second limb mounting pockets 30, 32.

The upper and lower limbs 22, 24 may include first and second connection points 50, 52. The connection points 50, 52 may be configured as apertures or openings that may extend through the upper and lower limbs 22, 24 to secure the limbs to the riser 12. The second connection point 52 may be constructed as a slot formed in the proximal end of limb 22. Slot 52 extends between the forward and rearward surfaces 46, 48 and is open along the end surface 42. Limb bolt assemblies 26, 28 secure the limb 22 to the riser through connection points 50, 52.

Each of the limbs 22, 24 may also include a connection aperture 54, as shown in FIG. 5. The aperture 54 may be sized to receive at least a portion of the connection apparatus 16. The aperture 54 may be positioned at a location between the first and second connection points 50, 52. In other examples, the aperture 54 may be positioned proximal of the first connection point 50 at a location spaced between the proximal end 36 and the first connection point 50 (see connection apparatus aperture 154 in FIG. 5).

The aperture 54 may be positioned at any location on the limb 22. In one example, the aperture 54 may be positioned along a center line that is equally spaced between opposing side surfaces of the limb. The aperture 54 may be circular in cross section. In other arrangements, the aperture 54 may have other cross-sectional shapes such as square, hexagonal or other polygonal shapes. The aperture 54 may extend only partially through the thickness of the limbs 22, 24 and may be structured as a recess rather than a pass-through bore. A single aperture may be positioned along the upper or lower limbs 22, 24. Alternatively, a plurality of apertures may be formed at any position along one or both of the upper and lower limbs 22, 24.

A connection apparatus 16 may be mounted to the limbs 22, 24 at the connection apparatus aperture 54. Alternatively, the connection apparatus 16 may be positioned at other locations that are independent of the apparatus aperture 54 such as, for example, along one of the forward and rearward surfaces 46, 48. The connection apparatus 16 may include a bushing 60 and a threaded bore 62 and may extend at least partially within the apparatus aperture 54. The bushing 60 and threaded bore 62 may connect together to form a connection apparatus assembly. The bushing 60 and threaded bore 62 may extend into the apparatus aperture 54 from opposing forward and rearward surfaces 46, 48. The bushing 60 and threaded bore 62 may be connected together with one of the limbs 22, 24 positioned there between. The bushing 60 and threaded bore 62 may be connected with a releasable connection such as a snap fit connection. Alternatively, the bushing 60 and threaded bore 62 may be connected together with an adhesive, latch, or other connection mechanism or material. The connection apparatus 16 may be mounted to the limbs 22, 24 with a permanent connection or a releasable connection.

The connection apparatus 16 may be arranged on the limbs 22, 24 so that the threaded bore 62 is accessible from the rearward facing surface 48. The threaded bore may be sized to receive a threaded shaft of the archery component or accessory that is mounted to the archery bow 10 via the connection apparatus 16. Alternatively, the threaded bore 62 may be accessible along the forward surface 46, or from both of the forward and rearward surfaces 46, 48.

The connection apparatus 16 may have other constructions and features to facilitate mounting of an archery component or accessory rather than using a threaded bore 62. For example, the connection apparatus 16 may include a bore that is not threaded. The connection apparatus 16 may alternatively include other connection features such as snap fit connection members, latches, brackets, interference fits, tapers, serrations or any other structure that may facilitate connection of an archery component or accessory to the limbs 22, 24. Alternatively, the connection apparatus 16 is defined as the connection apparatus aperture 54 that is formed directly in the limbs 22, 24. In one example, the connection apparatus aperture 54 is threaded so that the archery component or accessory is directly mounted to the limbs 22, 24 without an intervening feature such as the bushing 60 and threaded bore 62 shown in the figures.

The connection apparatus 16 may be mounted to one of the limbs 22, 24 to be facing in a direction generally away from the bow string 14. The connection apparatus 16 may be positioned axially spaced apart from the riser 20 toward the distal end portion 34. Alternatively, the connection apparatus 16 may be positioned laterally (i.e., in a front-to-back or a side-to-side) direction relative to a portion of the riser. The connection apparatus 16 may be positioned to be accessible from only a single side (i.e., the forward or rearward facing surface 46, 48) of one of the limbs 22, 24. An archery component or accessory, such as without limitation a dampener 70 (see FIG. 7) or stabilizer 170 (see FIGS. 8-9), may be mounted to one of the upper or lower limbs 22, 24 via the connection apparatus 16. The connection apparatus may be positioned distally of a proximal most portion of one of the limbs 22, 24. The connection apparatus may be positioned at a location that overlaps or is positioned adjacent to a portion of the riser. The connection apparatus may be positioned laterally from a portion of the riser and spaced apart from the riser.

The connection apparatus 16 may include additional structure interposed between the bushing 60 and threaded bore 62. In one example, the connection apparatus includes a vibration isolation member 80 sized for mounting within a connection aperture 154 (see FIGS. 10, 12 and 13A). The bushing and threaded bore 62 may be mounted within a pass-through bore 88 of the vibration isolation member 80. The vibration isolation member 80 may include a stem portion 82 that extends through the connection aperture 154, and first and second flange portions 84, 86 that may be positioned outside of the connection aperture 154 and in contact with forward and rearward surfaces 46, 48 of the upper limb 22, respectively. The first and second flange portions may help retain the vibration isolation member 80 mounted to the upper limb 22.

The vibration isolation member 80 may have various sizes and shapes to fit within different shaped and sized connection apertures of the upper and lower limbs 22, 24. In one arrangement, a connection aperture 154 positioned at a proximal end 36 of the upper limb 22 has a generally oval or elliptical shape (see FIG. 12). The stem portion 82 of the vibration isolation member 80 may have a similar oval or elliptical shape, or any other shape that fits within the connection aperture 154. Providing the flange portions 84, 86 may help retain the vibration isolation member 80 mounted within the connection aperture 154 regardless if the shape or size of the stem portion 82 closely matches the shape and size of the connection aperture 154.

The connection aperture 154 may have a circular shape similar to connection aperture 54, or may have any other desired shape and size that may be supported on the upper limb 22. For example, the connection aperture 154 may be oval, elliptical, rectangular, triangular, pentagonal, or hexagonal shaped. In at least one example, the connection aperture is constructed as an elongate slot, such as the slot shaped connection aperture 255 shown in FIG. 14A.

Figures 10, 11, 12:
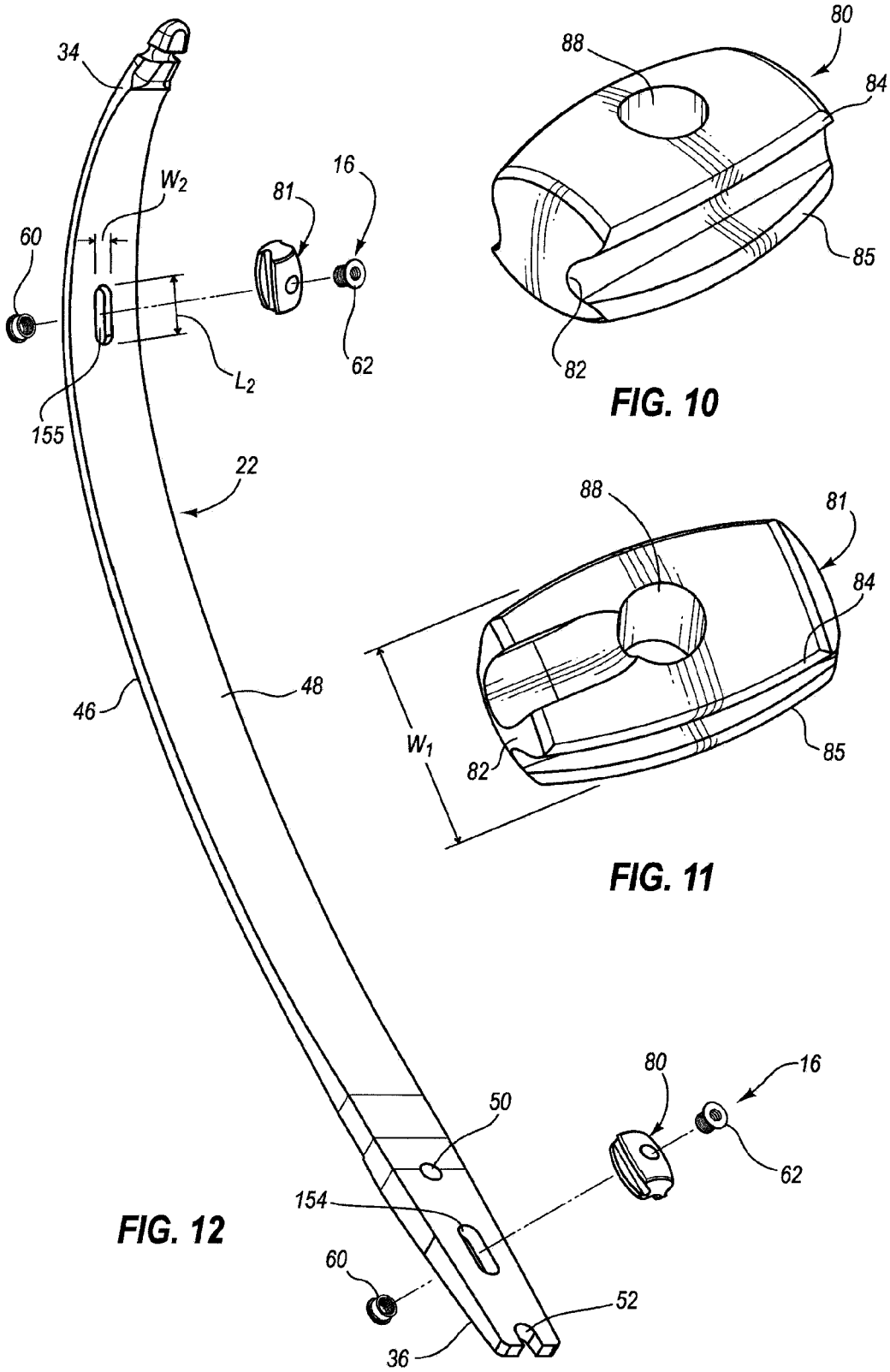
FIG. 10 is a perspective view of an example vibration isolation member in accordance with the present disclosure.
FIG. 11 is a perspective view of another example vibration isolation member in accordance with the present disclosure.
FIG. 12 is an exploded perspective view of another example upper limb for use with the archery bow shown in FIG. 1.

The upper limb 22 and lower limb 24 may include an additional connection aperture 155 positioned distal of the handle 20. The connection apertures 154, 155 may have the same size and shape as shown in FIG. 12. Alternatively, the connection apertures 154, 155 may have different sizes and shapes (e.g., the circular shaped aperture 54 shown in FIG. 5 and the slot shaped connection aperture 255 shown in FIG. 14A).

Separate vibration isolation members 80, 81 may be provided for each of the connection apertures 154, 155. While two vibration isolation member 80, 81 and two connection apertures 154, 155 are shown in FIGS. 12-13, other embodiments may include only one vibration isolation member, only one connection aperture, or more than two of each of a vibration isolation member and connection aperture. Vibration isolation members 80, 81 are shown in FIGS. 10-13 and may have a length $L_1$ and a width $W_1$. The length, width and other features of the vibration isolation members 80, 81 may be vary depending on, for example, the size and shape of the connection aperture within which each member 80, 81 is mounted, and other considerations such as the amount of damping functionality needed for each member 80, 81.

Figure 13A:
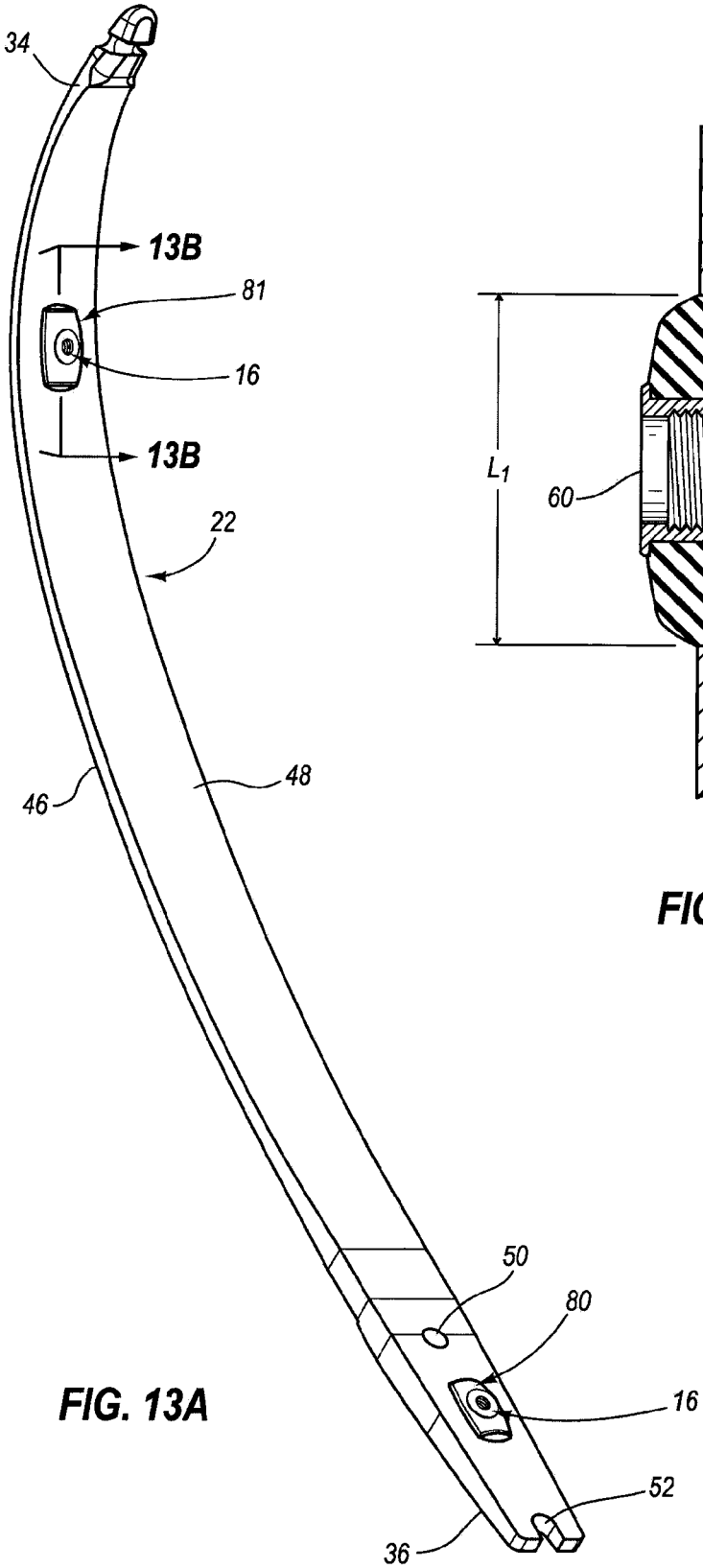
FIG. 13A is a perspective view of the upper limb shown in FIG. 12.
Figure 13B:
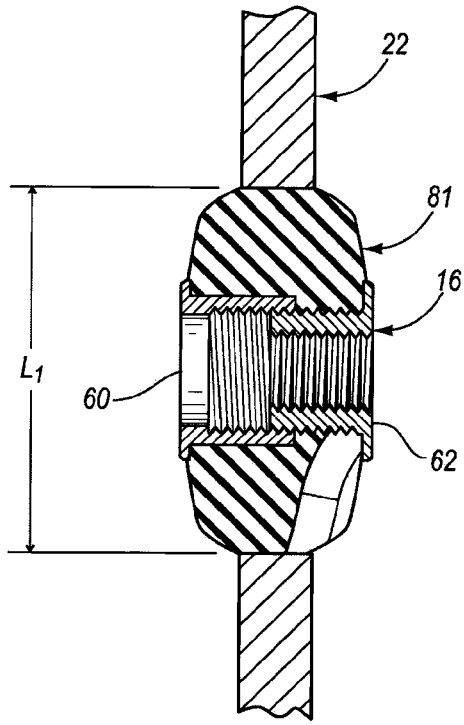
FIG. 13B is a cross-sectional view of a portion of the upper limb of FIG. 13A taken along cross-sectional indicators 13B-13B.

The slot shaped aperture 255 may have a length $L_2$ that is greater than the length $L_1$ of the vibration isolation member 81 (see FIGS. 11 and 13A). The vibration isolation member 81, alone or in combination with the bushing 60 and threaded bore 62, may define a connection apparatus 16 and may be moved in an axial direction A toward opposing distal and proximal ends 92, 94 of the slot 255 (see broken line representation of vibration isolation member 81 in FIG. 14A). The adjustable position of the vibration isolation member 81 within the slot shaped connection aperture 255 may provide adjustability in vibration dampening and mounting of accessories at different locations relative to the distal end 34 and the bowstring 14.

Figure 14A:
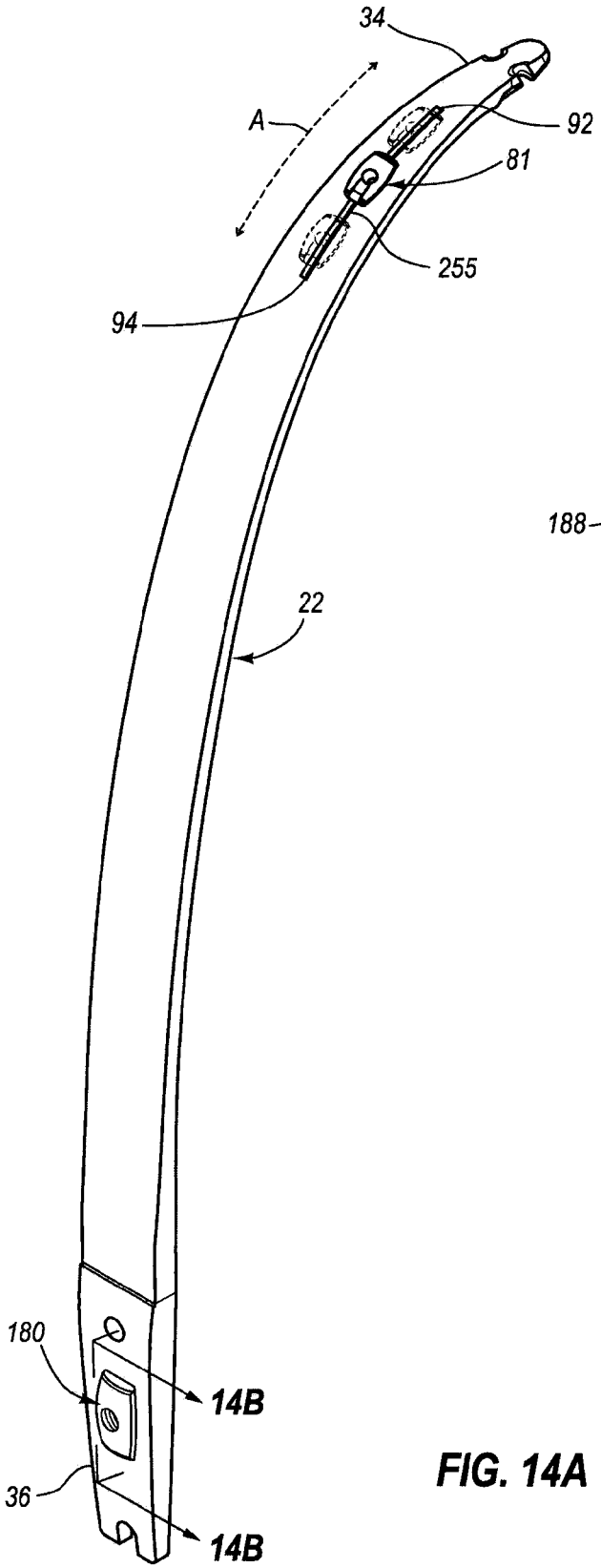
FIG. 14A is a perspective view of another example upper limb for use with the archery bow shown in FIG. 1.
Figure 14B:
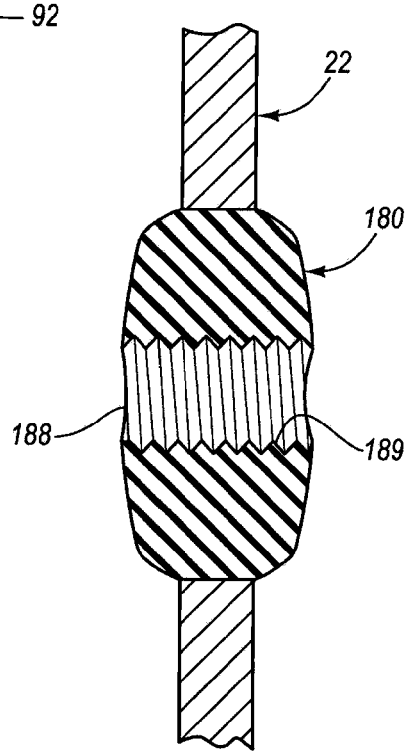
FIG. 14B is a cross-sectional view of a portion of the upper limb of FIG. 14A taken along cross-sectional indicators 14B-14B.

The connection apparatus 16 may include the vibration isolation member 180 alone, as shown in FIGS. 14A-B. The vibration isolation member 180 may include a bore 188 having a plurality of threads 189 defined therein. The threads 189 may be configured to threadably mount an accessory such as a dampener or stabilizer for the archery bow. The vibration isolation member 180 may function as a connection apparatus used to mount an accessory to a non-circular connection aperture of the limbs 22, 24.

The vibration isolation members 80, 81 may comprise a dampening material that dampens vibrations in the limbs 22, 24, handle 20, and bowstring 14. The vibration isolation member 80, 81 may provide an interface between an accessory and the limbs 22, 24, or between a bushing (e.g., bushing 60 and threaded bore 62) or other connection apparatus feature and the limbs 22, 24.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An archery bow, comprising:

a traditional archery bow assembly, comprising:

a handle assembly including a riser, an upper limb, and a lower limb, the upper and lower limbs each including a proximal end connected to the riser and a distal end;

a bowstring extending between the distal ends of the upper and lower limbs;

at least one connection apparatus formed in at least one of the upper or lower limbs;

wherein the upper and lower limbs are each connected to the riser at spaced attachment points along a length of the upper or lower limb, and the connection apparatus is positioned between the attachment points.

2. The traditional archery bow of claim 1 wherein the connection apparatus is open in a direction facing away from the bowstring.

3. The traditional archery bow of claim 1 wherein the connection apparatus includes a threaded bore.

4. The traditional archery bow of claim 1 wherein the connection apparatus is positioned distal of the riser.

5. The traditional archery bow of claim 1 wherein the connection apparatus is positioned lateral of a portion of the riser.

6. The traditional archery bow of claim 1 wherein the connection apparatus is accessible from a single side of the upper or lower limb.

7. The traditional archery bow of claim 1 further comprising a dampening member mounted to the connection apparatus.

8. The traditional archery bow of claim 1 further comprising a stabilizer mounted to the connection apparatus.

9. The traditional archery bow of claim 1 wherein the connection apparatus has a circular cross-sectional shape.

10. The traditional archery bow of claim 1 wherein the connection apparatus is positioned distal of a proximal end surface of the upper or lower limb to which the connection apparatus is mounted.

11. The traditional archery bow of claim 1, wherein the connection apparatus includes a vibration isolation member and a bushing mounted to the vibration isolation member, the bushing including internal threads.

12. The traditional archery bow of claim 11, wherein at least one connection apparatus includes an aperture formed therein, the vibration isolation member being mounted within the aperture.

13. The traditional archery bow of claim 12, wherein the aperture has a non-circular cross-sectional shape.

14. The traditional archery bow of claim 12, wherein the aperture is constructed as an elongate slot.

15. The traditional archery bow of claim 11, wherein vibration isolation member includes a dampening material.

16. The traditional archery bow of claim 11, wherein vibration isolation member includes comprises a rectangular cross-sectional shape.

17. A recurve archery bow handle assembly comprising:

a riser;

upper and lower limbs extending from opposite ends of the riser, each limb having a proximal end and a distal end;

a connection apparatus mounted to one of the limbs at a location distal of the proximal end of that limb and spaced from a connection point of that limb to the riser, the connection apparatus being positioned lateral of the riser.

18. The recurve archery bow handle assembly of claim 17, wherein the connection apparatus is positioned on a portion of the limb that overlaps a portion of the riser.

19. The recurve archery bow handle assembly of claim 17, wherein the connection apparatus is spaced apart from the riser.

20. The recurve archery bow handle assembly of claim 17, wherein the connection apparatus includes a bushing, the bushing defining a threaded bore.

21. A method of assembling a traditional archery bow, comprising:

providing a riser, a pair of limbs, a bowstring, and an accessory, at least one of the limbs having a connection apparatus mounted thereto;

connecting the limbs to opposite ends of the riser with the connection apparatus overlapping the riser and spaced from a point of connection of the limbs to the riser;

extending the bowstring from one limb to the other limb;

mounting the accessory to the connection apparatus.

22. The method of claim 21, wherein mounting the accessory to the connection apparatus includes threadably engaging a threaded shaft of the accessory with a threaded bore of the connection apparatus.

23. The method of claim 21, wherein mounting the at least one connection apparatus includes providing a threaded connection between the connection apparatus and the limb.

24. The method of claim 21, wherein connecting the limbs to opposite ends of the riser includes positioning the connection apparatus laterally from the riser.

25. The method of claim 21, wherein connecting the limbs to opposite ends of the riser includes positioning the connection apparatus spaced apart from the riser.

26. An archery bow, comprising:

a traditional archery bow assembly, comprising:

a handle assembly including a riser, an upper limb, and a lower limb, the upper and lower limbs each including a proximal end connected to the riser and a distal end;

a bowstring extending between the distal ends of the upper and lower limbs;

at least one connection apparatus formed in at least one of the upper or lower limbs;

wherein the connection apparatus includes a vibration isolation member and a bushing mounted to the vibration isolation member, the bushing including internal threads.

27. The traditional archery bow of claim 26, wherein at least one connection apparatus includes an aperture formed therein, the vibration isolation member being mounted within the aperture.

28. The traditional archery bow of claim 27, wherein the aperture has a non-circular cross-sectional shape.

29. The traditional archery bow of claim 27, wherein the aperture is constructed as an elongate slot.

30. The traditional archery bow of claim 26, wherein vibration isolation member includes a dampening material.

31. The traditional archery bow of claim 26, wherein vibration isolation member includes comprises a rectangular cross-sectional shape.

32. A method of assembling a traditional archery bow, comprising:

providing a riser, a pair of limbs, a bowstring, and an accessory, at least one of the limbs having a connection apparatus mounted thereto;

connecting the limbs to opposite ends of the riser;

extending the bowstring from one limb to the other limb;

mounting the accessory to the connection apparatus;

wherein mounting the at least one connection apparatus includes providing a threaded connection between the connection apparatus and the limb.

* * * * *